US008550243B2

(12) United States Patent
Moore

(10) Patent No.: US 8,550,243 B2
(45) Date of Patent: Oct. 8, 2013

(54) EXERCISE EQUIPMENT CARRIER

(76) Inventor: Tiffany Moore, Arlington, VA (US)

( * ) Notice: Subject to any disclaimer, the term of this patent is extended or adjusted under 35 U.S.C. 154(b) by 0 days.

(21) Appl. No.: 12/786,176

(22) Filed: May 24, 2010

(65) Prior Publication Data

US 2010/0300906 A1 Dec. 2, 2010

Related U.S. Application Data

(60) Provisional application No. 61/213,287, filed on May 26, 2009.

(51) Int. Cl.
*B65D 85/20* (2006.01)

(52) U.S. Cl.
USPC ..... 206/315.1; 206/579; 224/650; 224/271; 224/153

(58) Field of Classification Search
USPC ..... 206/315.1, 471, 478, 810, 803, 579, 206/576, 521, 480; 190/125, 126, 127; 224/650, 271, 576, 153, 584
See application file for complete search history.

(56) References Cited

U.S. PATENT DOCUMENTS

| | | | | |
|---|---|---|---|---|
| 4,431,185 | A | 2/1984 | Cisneros | |
| 4,477,074 | A * | 10/1984 | Bushnell | 482/108 |
| 5,230,674 | A | 7/1993 | Terauds | |
| 5,632,496 | A * | 5/1997 | Nelson | 280/30 |
| 5,697,870 | A | 12/1997 | Osborn | |
| 6,217,042 | B1 * | 4/2001 | Kurtz et al. | 280/37 |
| D459,074 | S | 6/2002 | Eckmann | |
| 7,001,315 | B1 | 2/2006 | Diodati | |
| 7,055,690 | B1 * | 6/2006 | Valdez et al. | 206/449 |
| 7,232,018 | B1 | 6/2007 | Salander | |
| 7,326,154 | B2 * | 2/2008 | Foley | 482/105 |
| D582,160 | S | 12/2008 | Sijmons | |
| 7,458,920 | B2 | 12/2008 | Hallar | |
| 7,575,136 | B2 * | 8/2009 | Kernkamp | 224/159 |
| 2005/0051445 | A1 | 3/2005 | Meehan et al. | |
| 2006/0027471 | A1 | 2/2006 | Ji Ping | |
| 2007/0049469 | A1 | 3/2007 | Brown | |
| 2008/0023355 | A1 | 1/2008 | Reynolds | |
| 2008/0251341 | A1 | 10/2008 | Murdoch et al. | |

FOREIGN PATENT DOCUMENTS

| | | | | |
|---|---|---|---|---|
| FR | 002699874 A1 * | 7/1994 | | 224/42.38 |
| GB | 2 287 644 A | 9/1995 | | |

OTHER PUBLICATIONS

24" Cordura Sport Travel Duffel Bag, 2 pages printed from the Internet on Jan. 14, 2009, http://www.onlinesports.com/pages/I,HSS-K108.html?srcid=googlebase&utm_source=googlebase&utm_medium=cpc&utm_term=HSS-K108&cm_mmc=googlebase-_-Products-_-PPC-_-HSS-K108.

Traveler's Choice TC3900G—Rome 3 Piece Hard-shell Spinning/Rolling Luggage Set in Silver, 7 pages printed from the Internet onJan. 14, 2009. http://www.luggage.com/asp/show_detail.asp?sku=UD1117&refid=FR52-UD1117.

* cited by examiner

*Primary Examiner* — J. Gregory Pickett
*Assistant Examiner* — Raven Collins
(74) *Attorney, Agent, or Firm* — Berenato & White, LLC

(57) ABSTRACT

Disclosed are exercise equipment carriers and methods providing a portable carrier for a variety of exercise and physical training equipment. An exemplary carrier includes a housing having a rear panel, a sidewall and an open front end defining an open interior region for receiving a plurality of dumbbells.

13 Claims, 9 Drawing Sheets

EXERCISE EQUIPMENT CARRIER

This Application claims the benefit of U.S. application Ser. No. 61/213,287 of TIFFANY L. MOORE filed May 26, 2009 for EXERCISE EQUIPMENT CARRIER, the contents of which are herein incorporated by reference.

BACKGROUND OF THE INVENTION

1. Field of the Invention

The present invention relates to luggage and equipment carriers and particularly to luggage and equipment carriers configured to carry exercise related accessories to perform exercise and/or physical therapy modalities.

2. Description of the Related Art

Custom-designed "gym bags" are currently manufactured for many sporting activities, which have specific carrying purposes available. Hockey, lacrosse, skis, & snowboard; fishing & shooting, diving/snorkeling, hunting, figure skating, skateboarding, and martial arts. Sporting bags currently available accommodate equipment such as, volley, basket, bowling and soccer balls, rackets, helmets, bats, golf clubs, and inline-skates.

Due to the wide variety of interests of those wishing to engage in an exercise program exists. Fitness and rehabilitation centers and gyms offer wide varieties of equipment for users, but the fitness enthusiasts, disabled and/or physically injured individual may prefer in-home services. For such individuals, personal fitness instructors, as well as physical therapists, that travel to their clients are available.

SUMMARY OF THE INVENTION

An object of the present invention is to provide an equipment carrier for professionals working in the medical and/or exercise & fitness industry.

To achieve this and other objects of the present invention, an exercise equipment carrier, comprises a housing having a rear panel, a sidewall, and a front panel defining an interior; and a plurality of retention prongs protruding from the rear panel into the interior for releasably securing exercise equipment.

According to another aspect of the present invention a backpack comprises a housing having a rear panel, a sidewall, and a front panel defining an interior, the front panel having a plurality of closable openings configured to afford access to the interior; and a plurality of retention prongs protruding from the rear panel into the interior for releasably securing exercise equipment. The rear panel includes a frame comprising a rubber layer secured to a polymethylmethacrylate layer, e.g., Plexiglas®, plurality of horizontal bars secured to the Plexiglas® layer, and a plurality of vertical bars secured to the horizontal bars with bolts, wherein the plurality of retention prongs are secured to the vertical bars. The closable openings include zippers.

According to yet another aspect of the present invention an exercise equipment carrier, comprises a housing having a rear panel, a sidewall and an open front end, the rear panel and the a sidewall defining an open interior region adapted for receiving a plurality of dumbbells; means for releasably securing the plurality of dumbbells within the housing; a door pivotally attached to the housing for releasably covering and sealing the open front end thereof; a panel pivotally attached to the door, the panel selectively covering an interior surface of the door, the panel being positioned between the door and the housing when the exercise equipment carrier is in a closed configuration; a plurality of compartments disposed on opposed first and second surfaces of the panel; and means for releasably locking the door against the housing.

According to yet another aspect of the present invention, there is a method for operating with a housing having a rear panel, a sidewall and an open front end, the rear panel and the a sidewall defining an open interior region adapted for receiving a plurality of dumbbells; a door; a panel when the exercise equipment carrier is in a closed configuration; a plurality of compartments disposed on opposed first and second surfaces of the panel. The method comprises releasably securing the plurality of dumbbells within the housing; pivoting the door to releasably cover and seal the open front end of the housing; pivoting the panel to selectively cover an interior surface of the door, to position the panel between the door and the housing when the exercise equipment carrier is in a closed configuration; and releasably locking the door against the housing.

These and other features of exemplary embodiments of the present invention will become readily apparent upon further review of the following specification and drawings.

The accompanying drawings which are incorporated in and which constitute a part of this specification, illustrate embodiments of the invention and, together with the description, explain the principles of the invention, and additional advantages thereof. Throughout the drawings, corresponding elements are labeled with corresponding reference numbers.

DETAILED DESCRIPTION OF EXEMPLARY EMBODIMENTS

Figure 1:
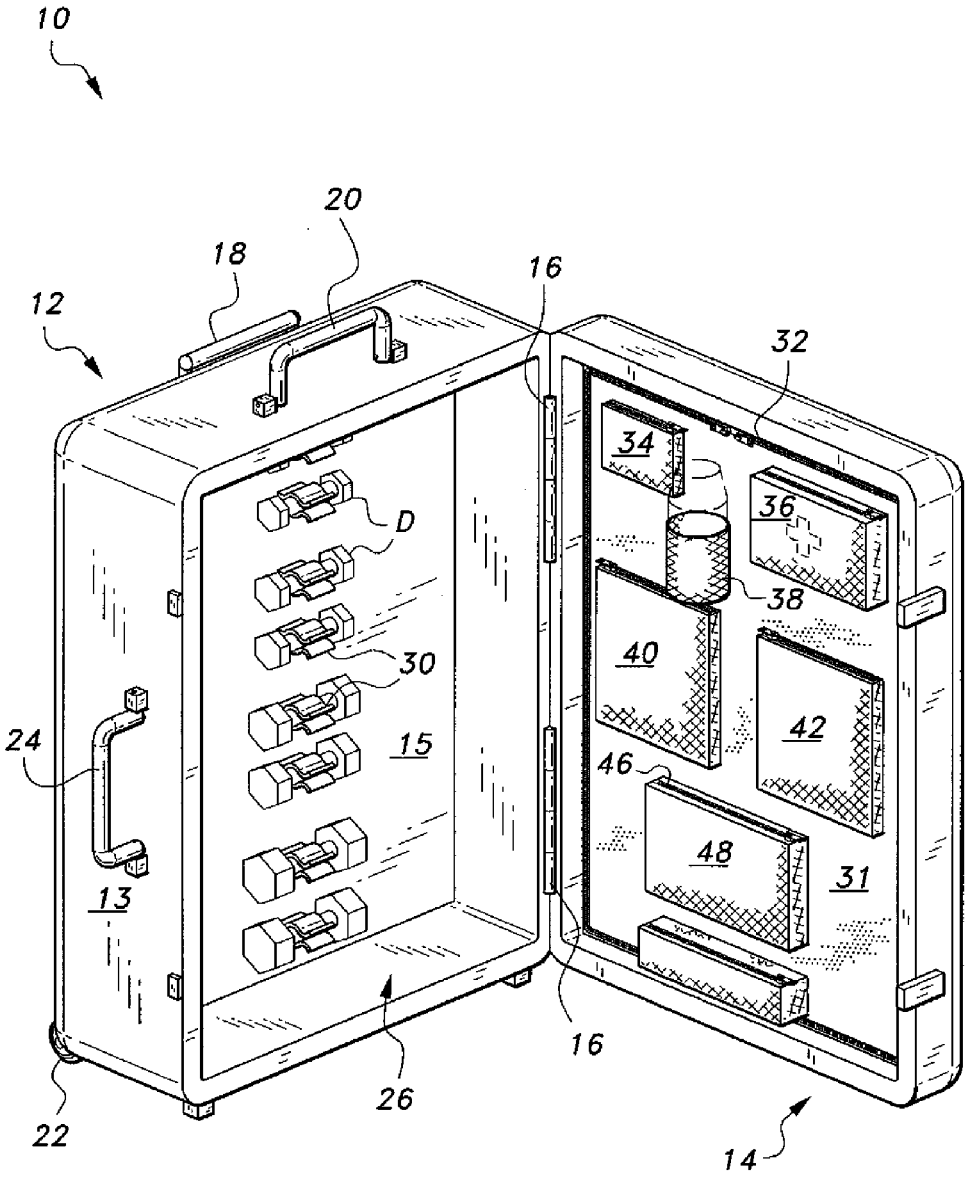
FIG. 1 is a perspective view of an exercise equipment carrier according to an exemplary embodiment of the present invention in an open configuration.

Referring to FIG. 1, the exercise equipment carrier 10 provides a portable carrier for a wide variety of exercise and physical training equipment. The various pieces of equipment shown in the drawings are shown for exemplary purposes only, and that the exercise equipment carrier 10 may be used for transporting any desired exercise or training-related equipment.

The exercise equipment carrier 10 includes a housing 12 having a rear panel 15, a sidewall 13 and an open front end. Preferably, housing 12 is configured such that, in combination with door 14 (to be described in greater detail below), the exercise equipment carrier 10 resembles a conventional suitcase or piece of easily transportable luggage. The dimensions and contouring of exercise equipment carrier 10 are shown for exemplary purposes only, and may be varied dependent upon the nature of exercise or training-related equipment to be transported therein. Further, the user may utilize a variety of exercise equipment carriers 10, each containing a unique assortment of exercise equipment therein, depending upon the particular type of training exercises in which the user intends to engage.

The rear panel 15 and the a sidewall 13 define an open interior region 26, similar in configuration to the interior of a conventional suitcase or piece of luggage, adapted for receiving a plurality of dumbbells D, as shown. The dumbbells D are preferably provided in a range of weights, and may be arranged within the housing in sequential order, based upon weight. Preferably, as shown, the dumbbells D are arrayed substantially linearly, extending along the vertical. A plurality of C-shaped clips 30 or the like are preferably secured to an interior surface of the rear panel, within interior region 26, for releasably securing the plurality of dumbbells D within the housing 12. Any suitable types of clips, clamps or other releasably engaging members may be utilized to removably secure dumbbells D within housing 12.

Door 14 is pivotally secured to the housing 12, adjacent the open front end thereof, for releasably covering and sealing the open front end of housing 12. The door 14 is secured to the housing 12 by hinges or the like. Housing 12 and door 14 may be formed from any suitable material, such as those typically associated with suitcases or luggage. The housing 12 and door 14 form a case similar to a conventional suitcase or the like, and the door 14 may be releasably secured to the open front end of the housing 12 using clasps 62 (best shown in FIG. 5) or any other suitable releasable locking members. Additional fasteners typically associated with suitcases, such as straps, locks and the like, may also be utilized.

Figure 4:
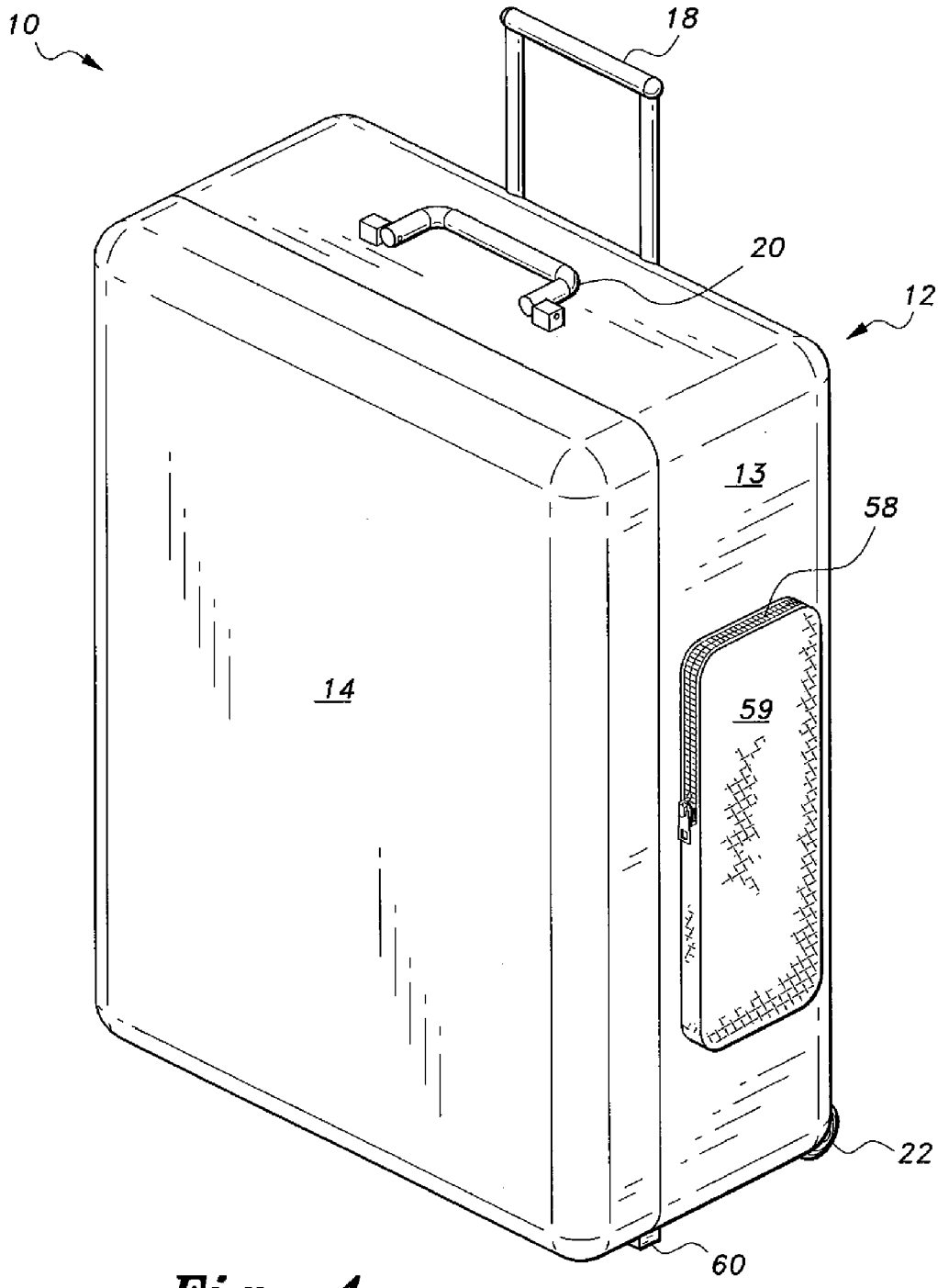
FIG. 4 is a front perspective view of the exercise equipment carrier according to an exemplary embodiment of the present invention, shown in a closed configuration.
Figure 5:
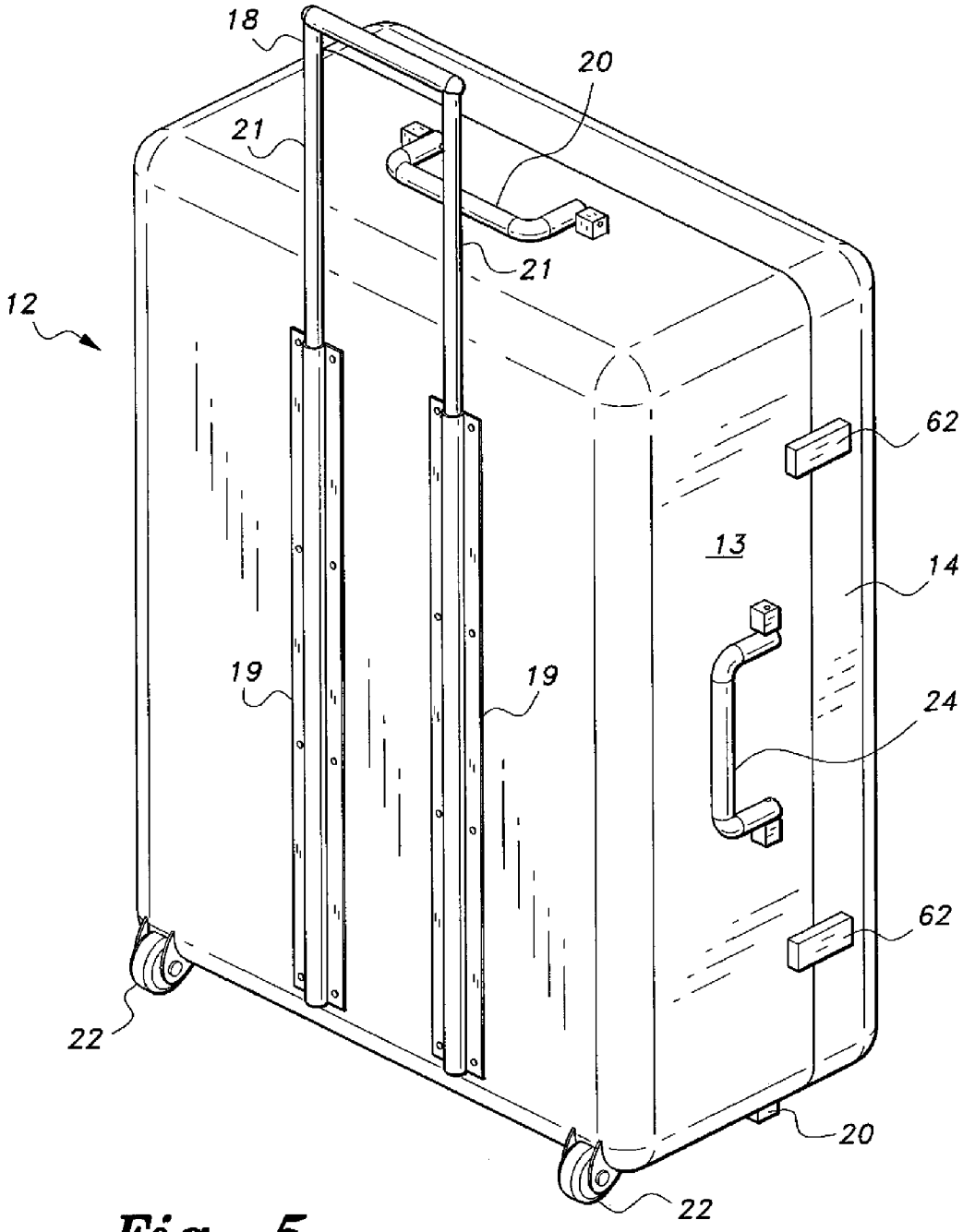
FIG. 5 is a rear perspective view of the exercise equipment carrier according to an exemplary embodiment of the present invention in a closed configuration.

As shown in FIGS. 1 and 5, wheels are preferably rotatably mounted on the lower end of housing 12, allowing the carrier 10 to be easily transported. Further, as shown in FIG. 4, a pair of rests or support members 60 are preferably mounted on the lower end of housing 12, adjacent the open front end thereof, allowing the carrier 10 to stably rest on the floor (or any other suitable support surface) in the upright position. Rests 60 are preferably formed from rubber or any other suitable, frictionally engaging material which will prevent rolling of carrier 10 when positioned in the upright position.

Further, as shown in FIGS. 1, 4 and 5, a retractable handle 18, as are well known in the field of suitcases and luggage, may be slidably mounted to the rear panel 15 of housing 12, along with an upper handle 20, mounted on the upper wall of housing 12. An additional side handle 24 may further be mounted on the a sidewall 13. Preferably, as shown in FIG. 5, the retractable handle includes a pair of vertical, sliding members 21, which are slidably received within sleeves 19. Sleeves 19 are mounted to the outer face of rear panel 15. Preferably, sleeves 19 are adapted to act as skids when the carrier 10 is dragged up a staircase, for example.

As shown in FIG. 4, additional pockets or pouches, such as pouch 58, may be formed on the exterior of housing 12 in any desired location. The number and positioning of the external pouches is dependent upon the particular needs of the user. The exemplary pouch 58 is mounted on the a sidewall of housing 12, laterally opposite from the side handle 24, and is releasably sealed by zipper 59. Any suitable releasable fastener may be used.

Figure 2:
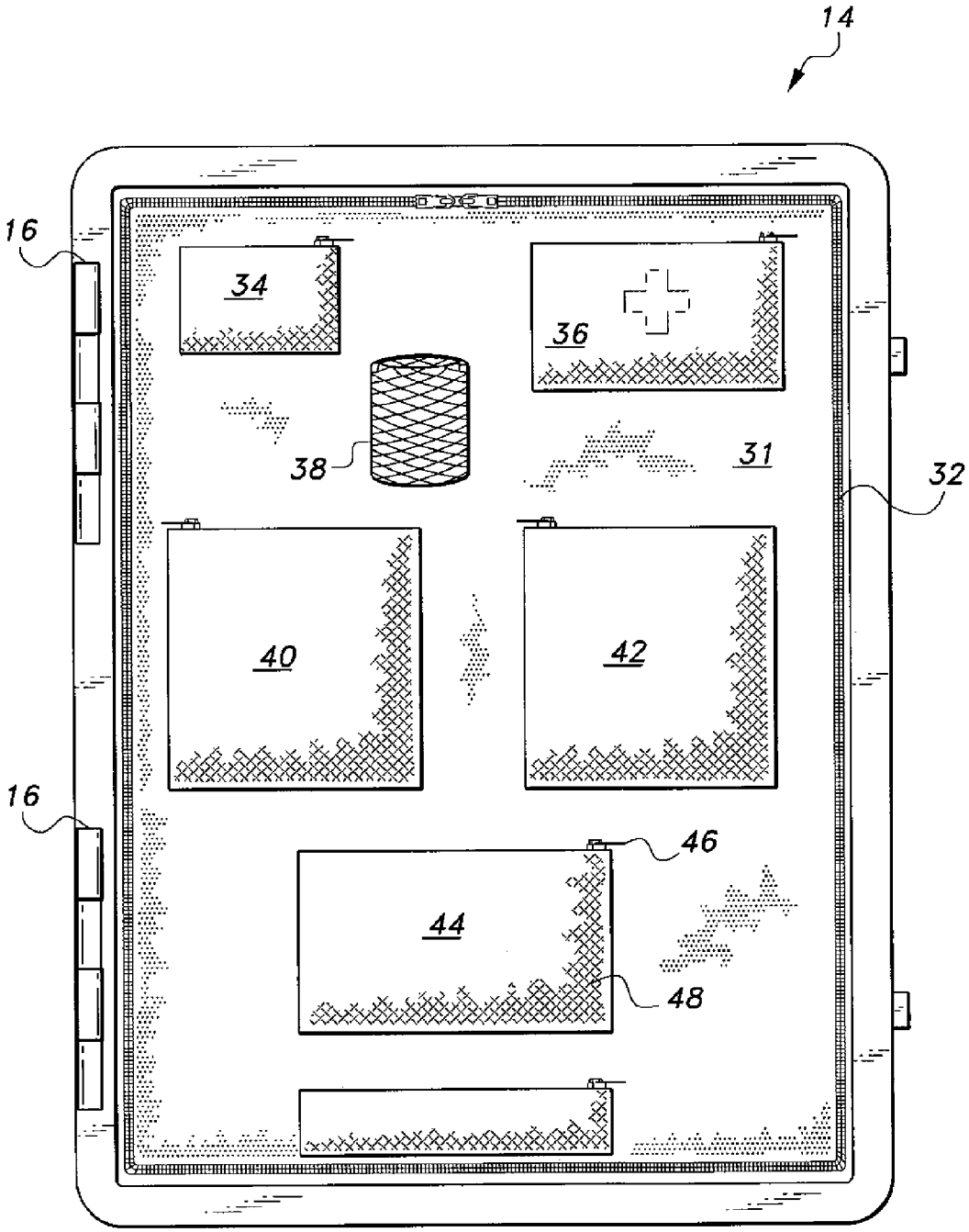
FIG. 2 is a plan view of a door of the exercise equipment carrier, shown with a panel associated with the door covering an interior surface thereof.
Figure 3:
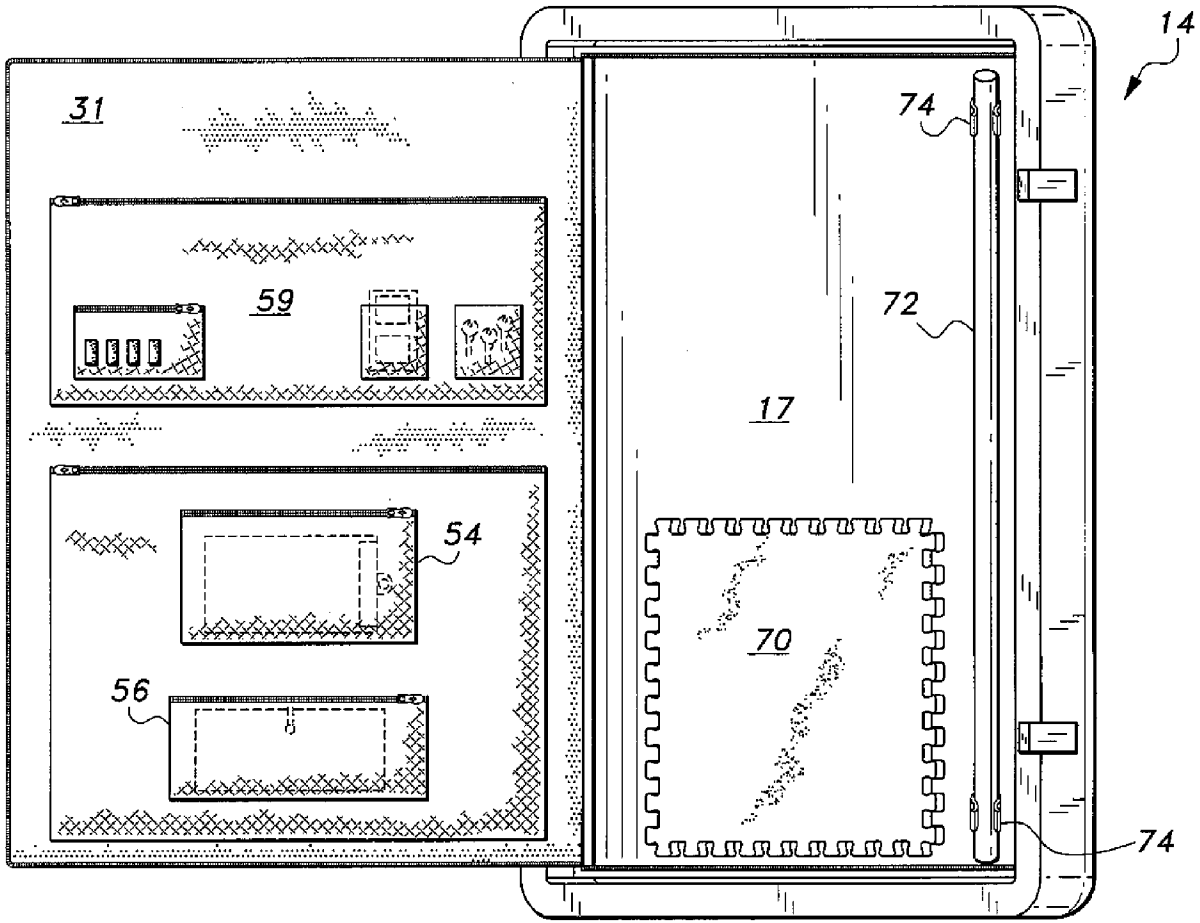
FIG. 3 is a plan view of the door and panel of FIG. 2, shown with the panel in an open configuration with respect to the interior surface of the door.

As best shown in FIGS. 2 and 3, a panel 30, which may be formed from fabric, vinyl or the like, is preferably, pivotally secured to the door 14 such that the panel 31 selectively covers an interior surface 17 of the door 14. FIG. 2 illustrates the panel 31 covering the interior face of door 14, with the panel 31 being held in place with respect to door 14 by a zipper 32, which is secured peripherally about both panel 30 and the interior of door 14. The panel 31 is positioned between the door 14 and the open front end of the housing 12 when the exercise equipment carrier 10 is in a closed configuration (as in FIGS. 4 and 5). Panel 31 may be secured to door 14 via any suitable releasable fastener.

A plurality of compartments are mounted on opposed first and second surfaces of the panel for storing exercise and training-related equipment. In FIG. 2, the panel 31 fully covers the interior surface 17 of door 14, displaying the first surface thereof, and the first set of pouches mounted thereto. Pouches 34, 36, 38, 40, 42 and 44 are shown for exemplary purposes only, and that the number and configuration of the pouches may be varied, dependent upon the nature of the exercise equipment to be stored therein. Similarly, the choice of training equipment illustrated in FIG. 2 is shown for exemplary purposes only, including an exemplary first aid kit, an exemplary water bottle, exemplary jump ropes and straps, and exemplary yoga blocks. Each pouch is preferably formed as a pocket, which may include a mesh front panel, as illustrated, allowing the user to easily see the contents of each pouch. Each pouch is sealed by any suitable type of releasable fastener, such as exemplary zipper 46 of pouch 44.

In FIG. 3, zipper 32 has been unzipped, thus releasing the panel 31 from the interior surface 17 of door 14, revealing the second surface of the panel 31. Similar to that described above, pouches 50, 52, 54 and 56 (with pouches 54 and 56 being mounted within larger pouch 52) are shown for exemplary purposes only, and that the number and configuration of the pouches may be varied, dependent upon the nature of the exercise equipment to be stored therein. Similarly, the choice of training equipment illustrated in FIG. 3 is shown for exemplary purposes only, including a cellular telephone and exemplary keys. Each pouch is preferably formed as a pocket, which may include a mesh front panel, as illustrated, allowing the user to easily see the contents of each pouch. Each pouch is sealed by any suitable type of releasable fastener, such as the exemplary zipper shown. Additionally, the space between interior surface 17 of door 14 and panel 31 may be utilized to store additional items. For example, a puzzle-type floor mat 70 may be stored therein, as shown, and a pair of clips 74, or any other suitable retaining elements, may be mounted to surface 17 for releasably securing a body bar 72, for example.

As noted above, the dimensions and contouring of exercise equipment carrier 10 are shown for exemplary purposes only, along with the exemplary exercise and training equipment shown stored therein, and the number and configuration of the internal and external pockets or pouches, and all may be varied dependent upon the nature of exercise or training-related equipment to be transported therein. Further, the user may utilize a variety of exercise equipment carriers 10, each containing a unique assortment of exercise equipment therein, and each having a unique configuration, dependent upon the particular type of training exercises in which the user intends to engage.

The exercise equipment carrier provides a portable carrier for a wide variety of exercise and physical training equipment. The exercise equipment carrier includes a housing having a rear panel, a sidewall and an open front end. The rear panel and the a sidewall define an open interior region adapted for receiving a plurality of dumbbells. The dumbbells are preferably provided in a range of weights, and may be arranged within the housing in sequential order, based upon weight. A plurality of C-shaped clips or the like are preferably secured to an interior surface of the rear panel for releasably securing the plurality of dumbbells within the housing.

A door is pivotally secured to the housing, adjacent the open front end thereof, for releasably covering and sealing the open front end. The door is secured to the housing by hinges or the like. The housing and door form a case similar to a conventional suitcase or the like, and the door may be releasably secured to the open front end of the housing clasps or any other suitable releasable locking members.

Preferably, a panel is pivotally secured to the door such that the panel selectively covers an interior surface of the door. The panel is positioned between the door and the open front end of the housing when the exercise equipment carrier is in a closed configuration. A plurality of compartments are mounted on opposed first and second surfaces of the panel for storing exercise and training-related equipment. The panel may be secured to the door, to releasably cover the interior surface thereof, by a peripheral zipper mounted about the perimeter of the panel and the peripheral edges of the interior surface of the door, or through the use of any other suitable type of releasable fastener.

Figure 6:
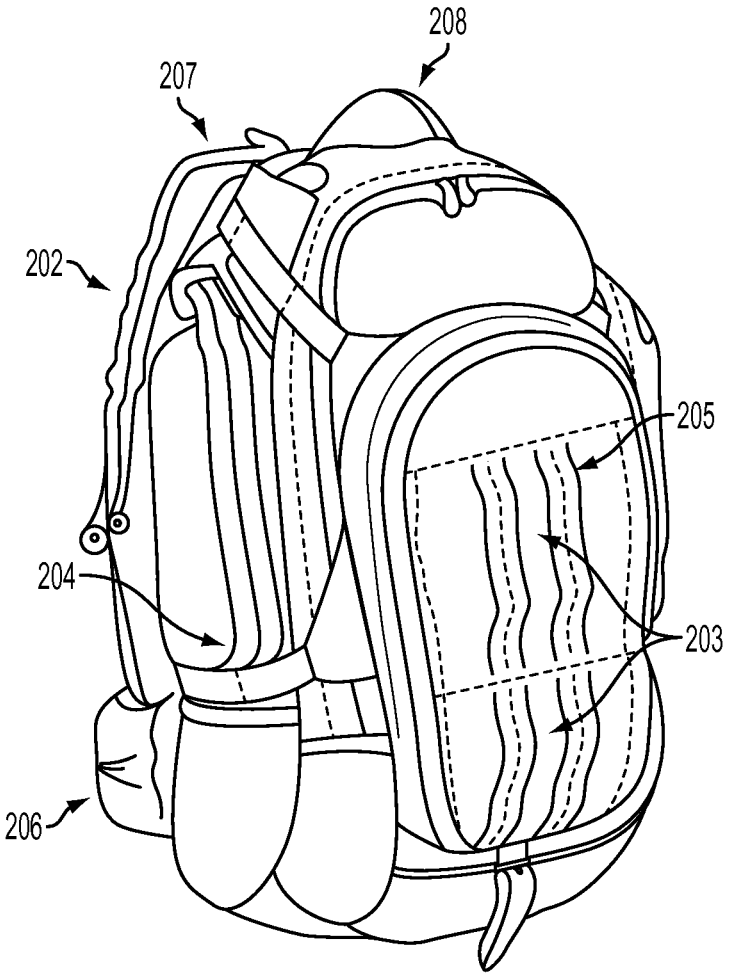
FIG. 6 is a perspective view of an exercise equipment carrier according to a second exemplary embodiment of the present invention.

FIG. 6 shows an exercise equipment carrier in accordance with a second exemplary embodiment. The exercise equipment carrier provides the ability to transport a wide variety of exercise equipment and accessories, such as, for example, dumbbells, barbells, resistant bands, client files, a first aid kit and jump ropes. The exercise equipment carrier includes a housing having a rear panel, a sidewall and an open front end that defines the front wall. The interior shell frame includes an aluminum frame. The aluminum frame includes a rubber pad Plexiglas® panel laminate with vertical and horizontal bars secured to an interior surface of the Plexiglas® with retention prongs for releasably securing the plurality of dumbbells within the housing. The dumbbells are preferably mounted in a vertical alignment and may be arranged within the housing in vertical sequential order, based upon the heavier weight at the bottom followed by lighter weights on the top.

Another piece of material is pivotally secured to the housing, adjacent the open front end thereof, for releasably covering and sealing the open front end. The flap is secured to the housing by a zipper fastener. The housing and the flap forms a case similar to a backpack or the like, and the flap may be releasably secured to the open front end of the housing zippers or any other suitable releasable locking members.

A plurality of compartments are vertically mounted on opposed first and second exteriors surfaces of the panel for storing exercise related equipment. In FIG. 6, the front wall 203 has exterior mesh upper compartment 205 and lower compartment 205 is secured to the interior flap on the perimeter of 202 the panel and the peripheral edges of the interior surface of the flap. Each compartment is sealed by a zipper or any suitable type of releasable fastener.

The exercise equipment carrier 201 may include any suitable carrier configured to transport and/or store exercise equipment, including, for example, dumbbells, barbells, resistance bands, jump ropes, or the like. In some embodiments, the carrier may include a backpack 201 as shown in FIG. 6. As an initial matter, the various pieces of equipment shown in the drawings are shown for exemplary purposes only, and that the disclosed exercise equipment carrier may be used for transporting any desired exercise or training-related equipment, as alluded to above. The exercise equipment carrier resembles a conventional backpack. The dimensions and contouring of exercise equipment carrier are shown for exemplary purposes only, and may be varied dependent upon the nature of exercise or training-related equipment to be transported therein. Further, the user may utilize a variety of exercise equipment carriers 201, each containing a unique assortment of exercise equipment therein, depending upon the particular type of training exercises in which the user intends to engage.

The rear panel 202, and a sidewall define an open interior region. Backpack 201 includes a housing having a rear panel, a sidewall, and a front panel 203 defining a the front panel having a closable opening configured to afford access to the interior; and a plurality of retention prongs protruding from 209 into the interior for releasably securing exercise equipment. The front panel 203 defines an open interior compartment 209 similar in configuration to the interior of a conventional back pack, adapted to hold an interior shell frame (to be described in greater detail below). Preferably, as shown, the dumbbells D are arrayed substantially linearly, extending along the vertical interior region 209. A plurality of retention prongs 210 are canted upwards for extra security and for releasably the plurality of dumbbells D within the aluminum frame 213. The interior frame or other releasably engaging members of these prongs may be utilized to removably secure dumbbells D within the interior of housing 209.

Front wall 203 has an interior compartment 209 sewed secured to the adjacent the open front end thereof, for releasably covering and sealing the open front end of housing 202. This interior compartment 209 is secured to the housing 203 by zippers or the like is secured with a zipper. Additional fasteners typically associated with backpacks, such as straps, and the like, may also be utilized.

Shoulder straps 207, as are well known in the field of back packs, may be slidably mounted to the rear panel of housing 202. Additional pockets or pouches, such as pouch 204 and 206, may be formed on the exterior of housing 202 in the desired location may be mounted to surface for securing a two piece body bar, for example. The number and positioning of the external pouches is dependent upon the particular needs of the user. The exemplary side pouches 204 are mounted on both sidewalls of housing 202 laterally opposite from the side walls 203 and are releasably sealed by zipper. Any suitable releasable fastener may be used.

Figure 7:
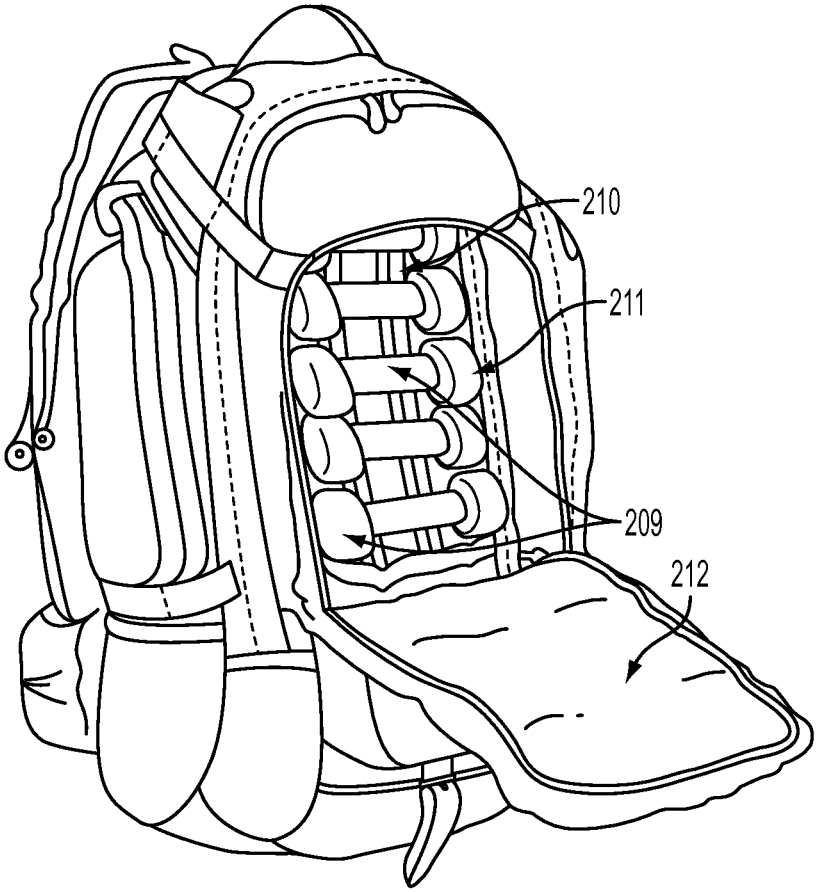
FIG. 7 is a perspective view of the exercise equipment carrier of FIG. 6 in an open configuration

A plurality of compartments are mounted on opposed first and second surfaces of the panel for storing exercise and training-related equipment and accessories. The panel 203 fully covers the interior surface, displaying the first surface thereof, and the first set of pouches mounted thereto. Pouches 204 for releasably securing a two piece body bar, for example. The exterior compartments 205 may be utilized to store a cellular telephone and exemplary keys and client files are shown for exemplary purposes only, and that the number and configuration of the pouches may be varied, dependent upon the nature of the exercise equipment to be stored therein. Similarly, the choice of equipment illustrated in FIG. 7 is shown for exemplary purposes only, interior compartment 212 including an exemplary first aid kit, an exemplary jump rope and resistance bands. Each compartment is preferably formed as a pocket, which may include a mesh front panel, as illustrated, allowing the user to easily see the contents of each compartment. Each compartment is sealed by any suitable type of releasable fastener.

In FIG. 7, interior compartment 209 has been unzipped, thus exposing the interior compartment 212 from the interior revealing the compartment. Similarly, the choice of training equipment illustrated in FIG. 7 is shown for exemplary purposes only. Each compartment is preferably formed as a compartment, which may include a mesh compartment panel, as illustrated, allowing the user to easily see the contents of each pouch. Each compartment is sealed by any suitable type of releasable fastener, such as the exemplary zipper shown. Additionally, the interior compartment 209 may be utilized to store additional items. Any other suitable retaining elements. The exterior compartments 205 may be utilized to store a cellular telephone and exemplary keys and client files.

Figure 8:
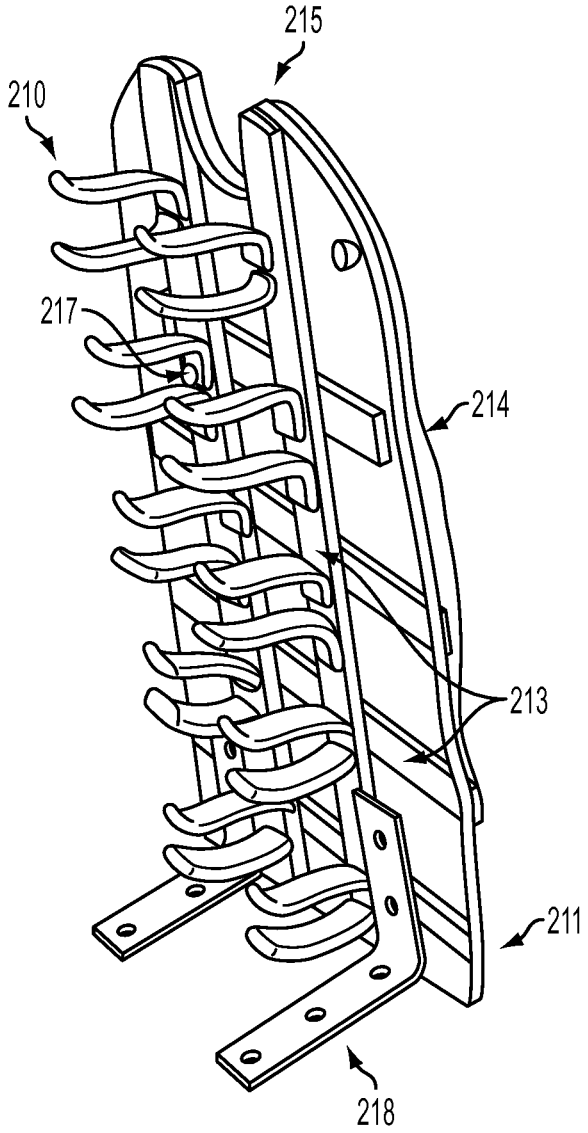
FIG. 8 is a front perspective view of the shell frame according to the second exemplary embodiment, shown in a side view configuration.

As shown in FIG. 8, the aluminum frame 213 includes a rubber pad 219, Plexiglas® panel laminate 216 with horizontal bars 214 and vertical bars 215 secured in place with bolts 217 secured to the surface of the Plexiglas® 216 with retention prongs 210 for releasably securing the plurality of dumbbells within the housing. The dumbbells are preferably mounted in a vertical alignment and may be arranged within the housing in vertical sequential order, based upon the heavier weight at the bottom followed by lighter weights on the top.

Figure 9:
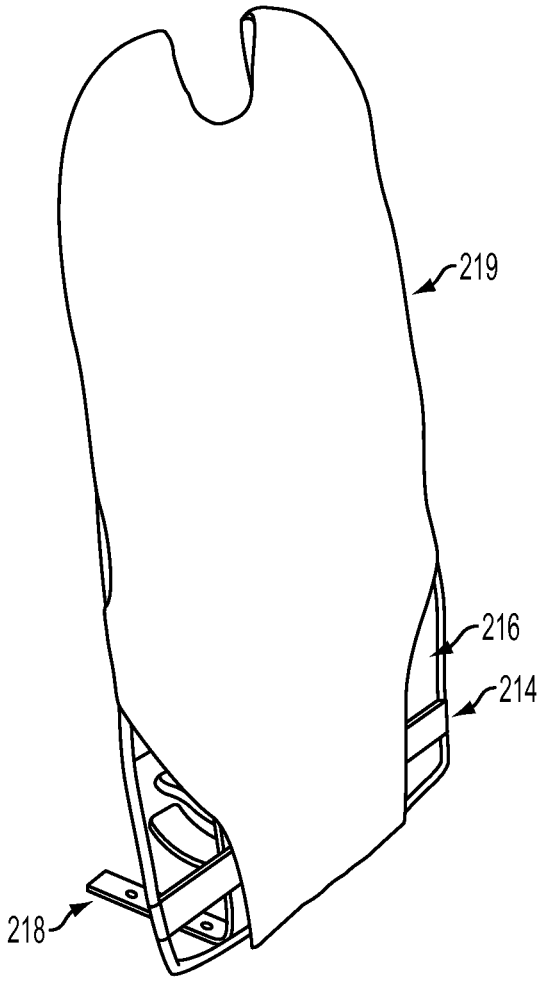
FIG. 9 is a rear perspective view of the frame according to the second exemplary embodiment, shown in a rear view configuration.

As shown in FIG. 9, the rear of the aluminum frame 213 is comprised of a rubber pad 219, Plexiglas® panel laminate 216 secured in place with bolts 217 to the horizontal bars 214 and vertical bars 215 that protrudes a stand 218.

As noted above, the dimensions and contouring of exercise equipment carrier 201 are shown for exemplary purposes only, along with the exemplary exercise and training equipment shown stored therein, and the number and configuration of the internal and external pockets or pouches, and all may be varied dependent upon the nature of exercise or training-related equipment to be transported therein. Further, the user may utilize a variety of exercise equipment carriers 201, each containing a unique assortment of exercise equipment therein, and each having a unique configuration, dependent upon the particular type of training exercises in which the user intends to engage.

The exercise equipment carrier provides the ability to have an interior frame like article to hold dumbbell weights and other compartments to store exercise related accessory equipment. The carrier includes a housing having a rear panel, a sidewall and an open front end defining an open interior region for receiving a plurality of dumbbells. The front panel defines an open interior region. An aluminum frame preferably secured to an interior surface of the rear panel affixed retention prongs for releasably securing the plurality of dumbbells within the housing. The dumbbells are preferably arranged in alignment within the aluminum frame in vertical sequential order, based upon the heavier weight at the bottom followed by the lighter weight on the top.

Similar to that described above, pouches 204, 205 and 206 (with pouches being mounted are shown for exemplary purposes only, and that the number and configuration of the pouches may be varied, dependent upon the nature of the exercise equipment to be stored therein.

SUMMARY OF REFERENCE NUMBERS IN SECOND EXEMPLARY EMBODIMENT

FIG. 6
201 Back Pack
202 Rear Side wall
203 Front wall
204 Side pouches (2)
205 Front pouches
206 Mesh pouch water bottle
207 Straps (2)
208 Handle
FIG. 7
209 Interior Region
210 Retention Prongs
211 Dumbbells
212 Interior compartment
FIG. 8
210 Retention prongs
213 Aluminum Frame
214 Horizontal Bars
215 Vertical bars
217 Bolts
218 stand
FIG. 9
214 Horizontal bars
216 Plexiglas®
218 stand
219 rubber pad Personal trainers, occupational and physical therapists must be well versed in multiple types of exercise styles, such as strength training, stretching and various cardiovascular exercises, and must carry the necessary equipment for a client's individual needs. Transporting a variety of equipment, can be cumbersome, particularly since there are a wide variety of related materials, such as first aid kits, resistant bands and client files. Thus, the exemplary carriers of the present invention are directed to this problem.

The exemplary carriers provide a convenient way to transport equipment to effectively service the clientele base, as the current gym bags available are relatively impractical and inconvenient. For example, if a conventional rolling sports duffle bag is used, the dumbbells remain at the bottom of the bag, as they cannot be secured in place.

Although gym bags, general sport equipment bags or even luggage with wheels are available, these articles are manufactured from materials that are not durable, lack compartmental space and are inadequate for accommodating exercise accessories necessary to provide professional services.

The exemplary carriers conveniently transport exercise equipment to and from residential homes, parks, fitness facilities and other places where the transportation of equipment is needed. The technology therein can be incorporated into a backpack, a rolling type duffle bag, or business tote.

Benefits, other advantages, and solutions to problems have been described above with regard to specific examples. The benefits, advantages, solutions to problems, and any element(s) that may cause any benefit, advantage, or solution to occur or become more pronounced are not critical, required, or essential feature or element of any of the claims.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims. In general, the words "first," "second," etc., employed in the claims do not necessarily denote an order.

I claim:

1. An exercise equipment carrier, comprising:

a housing having a rear panel, a sidewall, and a front panel defining an interior, a plurality of retention prongs protruding from the rear panel into the interior for releasably securing exercise equipment; and exercise equipment releasably secured in said plurality of retention prongs, wherein the exercise equipment comprises dumbbells.

2. The exercise equipment carrier of claim 1 wherein the housing has at least one closable opening configured to afford access to the interior.

3. The exercise equipment carrier of claim 1 further including a shoulder strap.

4. The exercise equipment carrier of claim 1 wherein the housing constitutes a backpack.

5. The exercise equipment carrier of claim 2 wherein the at least one closable opening comprises a zipper.

6. The exercise equipment carrier of claim 1 wherein the rear panel includes a padded layer secured to a rigid panel and a plurality of horizontal bars secured to the rigid panel.

7. The exercise equipment carrier of claim 6 wherein the rear panel further includes a plurality of vertical bars secured to the horizontal bars.

8. The exercise equipment carrier of claim 7 wherein the plurality of retention prongs is secured to the vertical bars.

9. The exercise equipment carrier of claim 7 wherein each of the plurality of vertical bars includes a lower portion extending in a direction perpendicular thereto.

10. The exercise equipment carrier of claim 6 where the padded layer comprises rubber.

11. The exercise equipment carrier of claim 6 wherein the rigid panel comprises polymethylmethacrylate.

12. The exercise equipment carrier of claim 1 further including a plurality of pouches.

13. A backpack comprising:

a housing having a rear panel, a sidewall, and a front panel defining an interior, the front panel having at least one closable opening configured to afford access to the interior; and a plurality of retention prongs protruding from the rear panel into the interior for releasable securing exercise equipment, wherein the rear panel includes a frame comprising, a rubber layer secured to a polymethylmethacrylate layer, plurality of horizontal bars secured to the polymethylmethacrylate layer, and a plurality of vertical bars secured to the horizontal bars with bolts, wherein the plurality of retention prongs are secured to the vertical bars, wherein the at least one closable opening comprises a zipper.

* * * * *